United States Patent [19]

Haage et al.

[11] 4,038,804

[45] Aug. 2, 1977

[54] MOUNTING ELEMENT FOR ROOFING HAVING LOOSELY LAID SYNTHETIC RESIN FILMS

[75] Inventors: Karl Haage, Troisdorf-Spich; Helmut Thelen, Troisdorf-Friedrich-Wilhelms-Hutte; Heinz Uedelhoven, Troisdorf, all of Germany

[73] Assignee: Dynamit Nobel Aktiengesellschaft, Germany

[21] Appl. No.: 574,450

[22] Filed: May 5, 1975

Related U.S. Application Data

[62] Division of Ser. No. 370,694, June 18, 1973, abandoned.

[30] Foreign Application Priority Data

June 16, 1972 Germany ..... 2229423

[51] Int. Cl.[2] ..... E04D 1/28; E04D 1/34; E04D 3/36

[52] U.S. Cl. ..... 52/746; 52/544; 52/478

[58] Field of Search ..... 156/71; 52/544, 419, 52/478, 516, 407, 145, 489, 408, 518, 543, 545, 515, 401, 746, 747, 748

[56] References Cited

U.S. PATENT DOCUMENTS

| | | | |
|---|---|---|---|
| 638,064 | 11/1899 | Reese | 52/528 |
| 2,009,512 | 7/1935 | Offutt et al. | 52/407 |
| 2,366,149 | 12/1944 | Robertson et al. | 52/478 |
| 2,896,271 | 7/1959 | Kloote et al. | 52/515 |
| 3,263,388 | 8/1966 | Bogert | 52/665 |
| 3,353,319 | 11/1967 | Gronlund | 52/748 |
| 3,468,086 | 9/1969 | Warner | 52/748 |
| 3,553,915 | 1/1971 | Passovoy | 52/241 |
| 3,774,363 | 11/1973 | Kent | 52/401 |

FOREIGN PATENT DOCUMENTS

| | | | |
|---|---|---|---|
| 687,907 | 2/1953 | United Kingdom | 52/544 |

OTHER PUBLICATIONS

Text: Gilbert Ford Kinney, Engineering Properties and Applications, New York, John Wiley & Sons, 1947, p. 37.

*Primary Examiner*—James L. Ridgill, Jr.
*Attorney, Agent, or Firm*—Craig & Antonelli

[57] ABSTRACT

A mounting element for synthetic resin films loosely laid on abutting thermal insulating panels for heat-insulated roof constructions without a gravel layer, which comprises a T-shaped panel securing means and a mounting flange means arranged at the base point of the T-shaped means at a right angle thereto and on one side thereof.

13 Claims, 4 Drawing Figures

FIG. 3
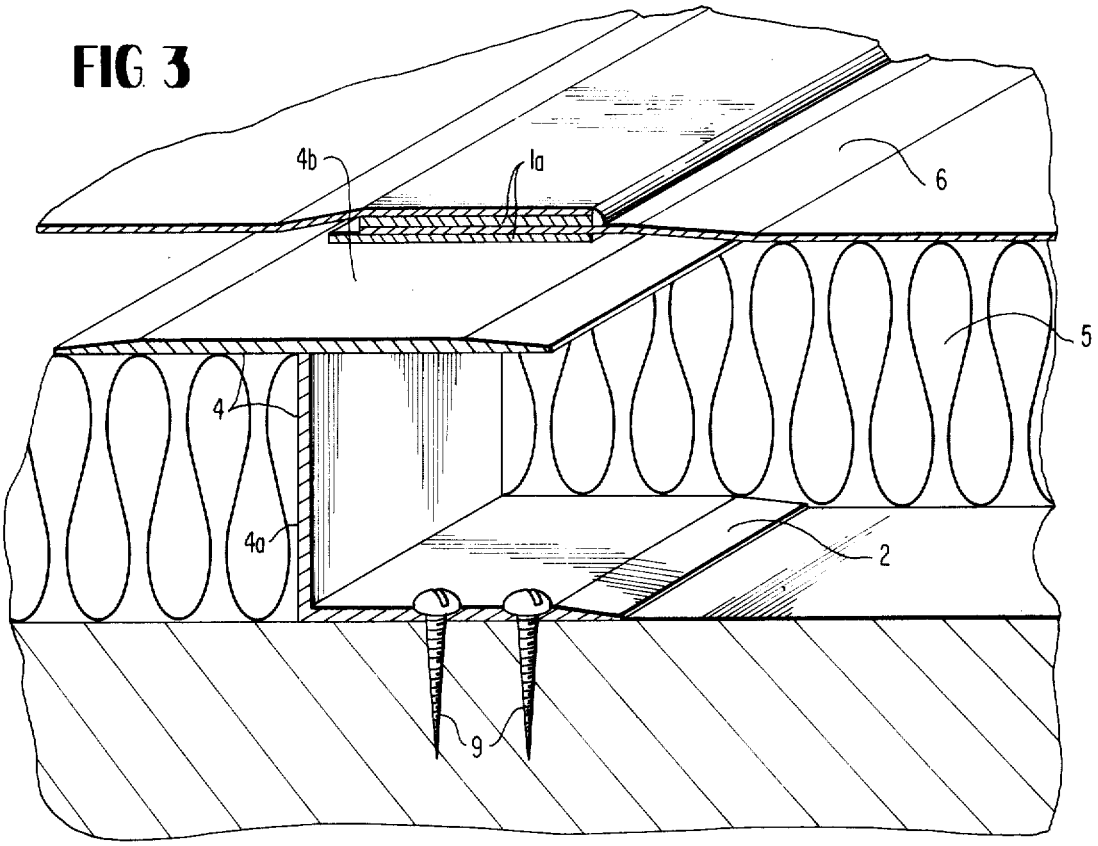
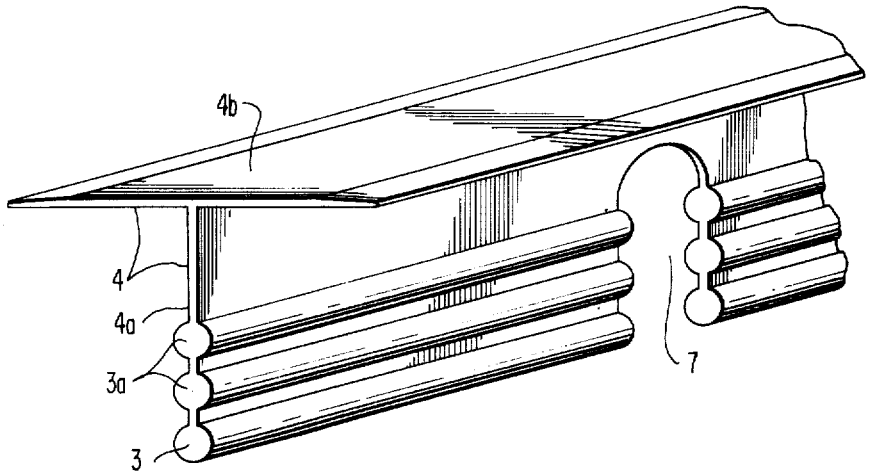
FIG. 4

MOUNTING ELEMENT FOR ROOFING HAVING LOOSELY LAID SYNTHETIC RESIN FILMS

This is a division of application Ser. No. 370,694 filed June 18, 1973, now abandoned.

This invention relates to a novel mounting element for synthetic resin films loosely laid on abutting panels, e.g. thermal insulating panels for heat-insulated roof constructions without a gravel layer, and to a process for the sealing of a heat-insulated roof with loosely laid synthetic resin films by using this novel mounting element and without a gravel layer.

Sheeting systems made up of loosely laid films and thermal insulating panels disposed therebelow are conventionally used for roof coverings. Protection against wind suction is attained in these constructions by a gravel layer placed thereon. In cases where a gravel load cannot be applied, for example, due to a lack of load-bearing capacity of the roof constructions, wooden planks or profiled sheet-metal sections are individually installed, with the aid of which a strip-shaped and point-like attachment of the loosely placed films is accomplished.

Such mounting systems are burdened by various disadvantages. Thus, wooden planks or boards are uneconomical when installed in roof constructions because of the high expenses for material and transportation and because of the relatively high amount of work involved. When using sheet-metal profiles, cold-conducting bridges are produced, where water of condensation can form. Besides, these conventional rigid, unelastic connecting systems using sheet-metal profiles have the disadvantage that they cannot absorb the peeling forces occurring by wind suction, especially in the zone of the junction seam of the film. Thus, it can happen, for example, that the film is torn off or the sheet-metal profile is deformed.

It is an object of the present invention to provide a mounting element or synthetic resin films loosely laid on abutting panels, e.g. thermal insulating panels for heat-insulated roof constructions, without a gravel layer, which mounting element does not have these disadvantages.

The mounting element of this invention is characterized in that it includes a T-shaped element or panel securing means as seen in cross section, and a mounting flange or flange means arranged at the base point of the T-shaped element on one side at a right angle thereto.

A further aspect of this invention is a process for sealing a heat-insulated roof without a gravel layer, wherein there are laid, on a roof foundation, loosely arranged sealing and insulating materials, e.g. thermal insulating panels, and on top thereof a loosely laid roof sheathing, preferably of a thermoplastic synthetic resin film, which process is characterized in that a mounting element of the present invention is arranged between the joints of the adjoining panels of the thermal insulating layer so that a connecting flange of the T-shaped element (i.e. the horizontal flange portion) encompasses two adjoining heat-insulating panels on the topside of the layer, and the mounting flange encompasses one of the adjoining heat-insulating panels at the underside; and the loosely laid roof sheathing is placed on the connecting flange of the T-shaped element and is attached thereto. In this manner, the connecting flange serves for attaching the mounting element to the roof foundation.

With the aid of the mounting elements of this invention, installed at the joints of the thermal insulating panels, it is possible to affix the roof sheathing at the desired and required spacing determined by the dimensions of each of the panels of the thermal insulating layer, so that no gravel coat is necessary.

According to this invention, the T-shaped mounting element can be fixedly joined to the mounting flange to form an integral mounting element. The integral mounting element of this invention can be installed either as an elongated, continuous, element or in the form of individual elements at spacings on the roof foundation through the mounting flange, e.g. in a point-like manner by means of screws, nails, or similar means.

In accordance with another aspect of this invention, it is advantageous to form the mounting element of two or more parts which are detachably connected with one another.

In an advantageous further embodiment of such a multisectional mounting element, the vertical web of the T profile is beaded or enlarged along its lower edge, and the detachable mounting flange has an edge or end portion with a groove, wherein the groove and the bead of the web are so constructed with regard to their dimensions, that the bead of the web is insertable in the groove of the mounting flange.

Such a mounting element can be installed, for example, by anchoring the mounting flange either in the form of short pieces or in the form of a continuous element to the roof foundation, for example, in a point-like manner by screws, nails, or the like; and thereafter introducing the bead of the web into this groove. The height of the web of the T profile is dependent on the thickness of the thermal insulating and sealing materials to be laid, i.e. the height present between the connecting flange of the T profile and the mounting flange must correspond at least to the thickness of the insulating panels, so that the insulated panels can be inserted therebetween.

In a further advantageous embodiment of this invention, the web of the T-shaped element has at least one further bead arranged in parallel to the bead at the lower edge. By means of such an end profile or configuration, the height of the web of the mounting element can be adapted to the layer thickness of the insulating and sealing material by cutting off the enlarged beam at the lower edge of the web, and optionally also additional enlarged sections or beads of the web, so that the subsequently following or remaining bead can be introduced into the groove of the mounting flange.

It is furthermore contemplated to form the mounting element of this invention so that the mounting flange, as seen in cross section, projects beyond the connecting flange of the T-shaped element. This configuration is suitable, in particular, for those mounting elements of this invention wherein the T-shaped element forms a unit with the mounting flange already during installation, and has the advantage that the attachment of the mounting flange to the roof foundation is readily possible.

In accordance with a further advantageous embodiment of the mounting element of this invention, the web of the T-shaped element is provided with recesses at its lower edge or end portion. This essentially simplifies the threading of the groove of the mounting flange into the beaded web of an elongated T-profile rail when using short mounting flange sections. For example, the step of laying the mounting flange or flanges can be accomplished by first attaching one of a plurality of relatively short mounting flanges (to be placed in alignment on the roof) to the roof foundation and placing the remaining mounting flanges at first loosely on the roof foundation at mutual spacings. An elongated T-shaped element or member is then introduced into the groove of the attached mounting flange with one end thereof. The subsequent loose mounting flanges are pushed over the bead of the web at each subsequent recess and displaced along the bead to the point where each mounting flange is finally attached to the roof foundation. This has the advantage that the entire T-shaped element need not be inserted through the grooves of all the mounting flanges along its entire length.

In case of elongated T-shaped elements, especially those without a recess, the procedure can also be, for example, to push, prior to the installation of the mounting element, all partial sections of the mounting flange (i.e. all of those mounting flanges which are aligned to form an assembly) over the bead of the web, and to shift each of the mounting flanges only at the site during the installation to the point on the roof foundation where the mounting is intended.

The connecting flange of the T-shaped element, which is under an especially strong stress in case of wind suction acting on the mounted film, due to vertical forces, is advantageously manufactured from an elastic material which withstands a sudden as well as a prolonged mechanical stress, which resumes its original configuration after termination of the stress, and which furthermore has a low heat conductivity. Optionally, the web of the T profile can also be made from the same elastic material. The mounting flange is suitably produced from a material or a combination of materials having sufficient structural rigidity.

Consequently, the provision is made in accordance with this invention to produce the mounting element at least partially from a synthetic resin.

In this regard, at least the connecting flange and optionally also the web of the T-shaped element can be made from an elastic synthetic resin, and the mounting flange can be produced from a harder synthetic resin or metal or plastic-enclosed metal. A suitable elastic synthetic resin is, for example, a soft-gauge PVC. Others include thermoplastic or elastomers such as butyl rubber. As the harder plastic, it is possible to use hard-gauge soft PVC, for example. Others include thermoplastic synthetic material such as polyethylene.

It is especially advantageous to attach the roofing sheaths at the connecting flange of the T-shaped element or elements by gluing or with the use of a welding procedure using heat or solvents. The connecting flange of the T profile can be joined to the roof sheathing over its entire surface area.

The invention will be explained in greater detail with reference to the accompanying drawings and to the following detailed description wherein:

FIG. 3 shows a cross-section through a one-piece or integral mounting element attached to the roof foundation; and FIG. 4 shows another embodiment of the T-shaped element of the mounting element of the invention.

Figure 1:
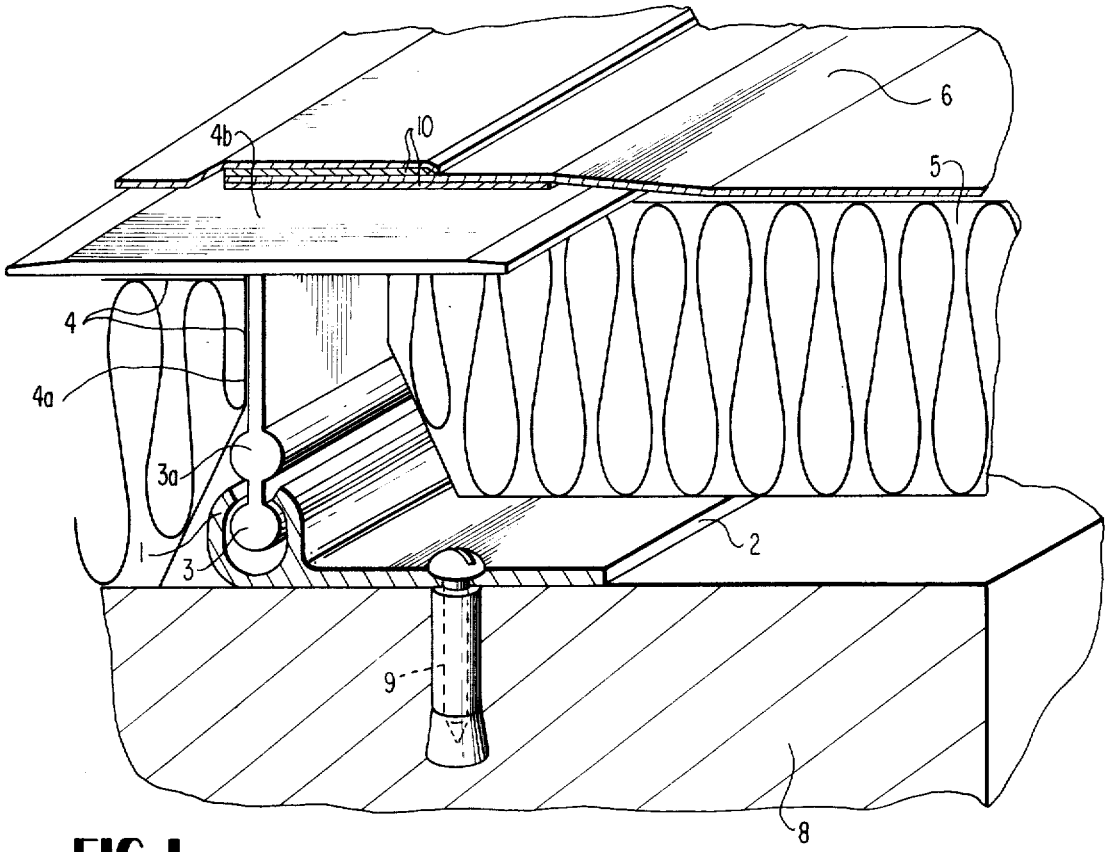
FIG. 1 shows a cross section through a two-part mounting element attached to the roof foundation.

In the heat-insulated roof shown in FIG. 1, the thermal insulating panels 5 made of polystyrene foam, polyurethane foam or phenolic resin foam are placed on top of the roof foundation 8. The mounting element 2, 4 composed in the illustrated example of the T-shaped element 4 and the mounting flange 2 detachably attached to the T-shaped element, is inserted in the zone between the individual abutting thermal insulating panels. The T-shaped element 4 of the mounting element is made, for example, of an elastic synthetic resin (e.g. butyl rubber) in the form of an elongated, continuous, profiled rail, and the web 4*a* is formed with superimposed beads on enlarged portions 3, 3*a* along its lower edge. Depending on the height of the thermal insulating panels 5, one of these beads is cut off, if required, and the mounting flange 2, having on one side a groove 1, which is open toward the top, is pushed onto the lowermost bead of the web 4*a*. The mounting flange 2 is attached to the roof foundation 8, for example, by means of a screw 9. It is not absolutely necessary that the mounting flange 2 be likewise fashioned as an elongated, continuous, rail; it is even advantageous to produce the mounting flange 2 in partial sections (i.e. to use a plurality of relatively short mounting flanges) and provide same only at spacings as required in accordance with existing conditions, and thus attach such sections (i.e. each individual mounting flange) to the foundation. Finally, the roof sheathing 6, for example of a synthetic resin, i.e. PVC soft films, elastomeric films or APTK films, is loosely laid on top of the mounting element attached (as heretofore described) to the roof foundation, the mounting element serving simultaneously, with its connecting flange 4*b* for the fixation of the thermal insulating panels 5. The roof sheathing is then flatly glued, welded or otherwise secured along and together with the connecting flange as well as with the adjoining partial exposed section of the roof sheathing, at 10.

Figure 2:
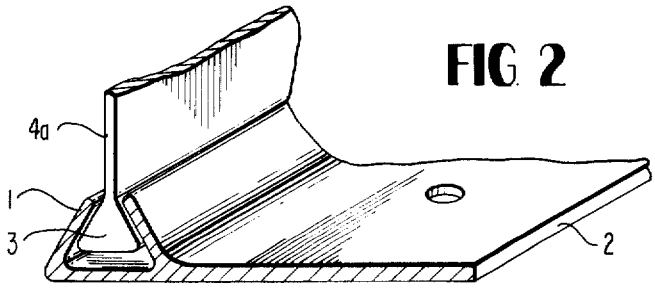
FIG. 2 shows a partial view of a different embodiment of the mounting element of this invention.

The beads 3, 3*a* of the web 4*a* of the T-shaped element forming part of the mounting element are illustrated with a round cross section in accordance with FIG. 1. However, it is also possible to make these beads of other cross-sectional configurations, e.g. of a triangular cross section, as can be seen from FIG. 2.

In FIG. 3, the mounting element 2, 4 is illustrated as an integral mounting element, wherein this mounting element is preferably illustrated as an elongated, continuous, profiled rail. Also, it is advantageous, as can be seen from FIG. 1 and FIG. 3, to fashion the width of the mounting flange larger than the width of the connecting flange 2, whereby the mounting flange can be attached to the foundation more easily by nails or screws.

In the construction of the mounting element 2, 4 as a multipartite element, wherein the T-shaped element and the mounting flange are detachably connected with each other, and wherein especially the mounting flange 2 is provided only in partial sections (i.e. a plurality of short mounting flanges are used) at spacings along the T-shaped element, the T-shaped rail according to FIG. 4 can be provided with recesses or cutout portions 7 at intervals. In this way, it is possible to install the individual mounting flange sections 2 at various desired points. This enables facilitation of the assembly, especially when long profiled rails must be laid on larger roofs wherein the rails have relatively many mounting points where the mounting flanges 2 are provided.

While the novel embodiments of the invention have been described, it will be understood that various omissions, modifications and changes in these embodiments may be made by one skilled in the art without departing from the spirit and scope of the invention.

What is claimed is:

1. A roofing system for covering a roof foundation comprising: at least two adjacent thermal insulating panels loosely arranged on said roof foundation and defining a space therebetween, a mounting element for mounting said thermal insulating panels to said roof foundation comprising a T-shaped panel securing means defining a generally planar connecting flange and a vertical web perpendicular to said connecting flange, and a mounting flange means connected at the base point of the T-shaped means and arranged at a right angle thereto on one side thereof, said mounting flange means being attached to said roof foundation, said T-shaped means being positioned in said space whereby said thermal insulating panels are loosely mounted to said roof foundation by said T-shaped means; and a plurality of adjoining cover sheets loosely covering said thermal insulating panels and the connecting flange of said T-shaped panel securing means, adjoining cover sheets contacting one another over said connecting flange, adjoining cover sheets being secured to one another and to said T-shaped panel securing means at the connecting flange of said T-shaped panel securing means.

2. The roofing system of claim 1, wherein said T-shaped means and said mounting flange means are rigidly connected to one another.

3. The roofing system of claim 1, wherein the mounting flange, as seen in cross section, projects beyond the connecting flange of the T-shaped means.

4. The roofing system of claim 1, in which said mounting element is at least partially made of a synthetic resin.

5. The roofing system of claim 4, in which at least the connecting flange of the T-shaped means is made from an elastic synthetic resin, and the mounting flange means is made from one of a harder synthetic resin, a metal, and a metal encased with a synthetic resin.

6. The roofing system of claim 5, wherein the vertical web of the T-shaped means is made from an elastic synthetic resin.

7. The roofing system of claim 6, wherein the connecting flange of the web of the T-shaped means is made from a member selected from the group consisting of PVC and butyl rubber.

8. The roofing system of claim 1, wherein said T-shaped means and said mounting flange means are made up of at least two parts detachably connected with one another.

9. The roofing system of claim 8, wherein the vertical web of the T-shaped means has a bead along its lower edge, and the mounting flange means includes at least one detachable mounting flange having an edge with a groove, wherein the groove and the bead of the web are so constructed in their dimensions with respect to each other that the bead of the web can be inserted in the groove.

10. The roofing system of claim 9, wherein the web of the T-shaped member has at least one additional bead arranged in parallel to the lower edge.

11. The roofing system of claim 9, wherein the T-shaped panel securing means is formed as an elongated profiled T-shaped rail and said mounting flange means comprises a plurality of separate partial sections, said partial sections being arranged at intervals along the length of said rail.

12. The roofing system of claim 11, wherein the web portion of the T-shaped rail is provided with recesses whereby said separate partial sections can be mounted on and attached to the web of the T-shaped means intermediate its ends without sliding said separate partial sections over the end of said web.

13. A process for forming a sealed, heat-insulated roof on a roof foundation comprising mounting on said roof foundation a plurality of mounting elements, each mounting element comprising (a) a T-shaped panel securing member having a generally planar connecting flange and a vertical web perpendicular to said connecting flange and (b) a mounting flange connected to a base of said T-shaped panel securing member and having a planar portion extending at a right angle thereto on one side thereof, securing the mounting flange of each of said plurality of mounting elements to said roof foundation, loosely laying on said roof foundation a plurality of thermal insulating panels, adjacent thermal insulating panels defining a space therebetween, said panels being arranged so that the T-shaped panel securing member of at least one of said mounting elements is between two of said adjacent panels with the connecting flange of said at least one mounting element encompassing the top sides of said two panels and the planar portion of the mounting flange of said at least one mounting element encompassing the under side of one of said two adjacent panels, loosely laying on said thermal insulating panels a plurality of adjoining cover sheets of thermoplastic synthetic resin film, said adjoining cover sheets being loosely laid on said thermal insulating panels in such a manner that adjoining cover sheets contact one another over the connecting flanges of said T-shaped panel securing member and securing adjoining cover sheets to one another and to said T-shaped panel securing members at the connecting flanges of said T-shaped panel securing members to provide a seal for said roof foundation.

* * * * *